United States Patent [19]

Ottesen

[11] 4,117,437

[45] Sep. 26, 1978

[54] TOP CORE TYPE CURRENT TRANSFORMER STRUCTURE

[75] Inventor: Otto Ottesen, Ludvika, Sweden

[73] Assignee: ASEA Aktiebolag, Vasteras, Sweden

[21] Appl. No.: 810,165

[22] Filed: Jun. 27, 1977

[30] Foreign Application Priority Data

Jul. 2, 1976 [SE] Sweden ..... 76075852

[51] Int. Cl.[2] ..... H01F 40/06

[52] U.S. Cl. ..... 336/69; 336/174

[58] Field of Search ..... 336/69, 70, 173, 174, 336/175, 90, 92, 94, 84 R, 84 C; 323/44 R; 361/268, 270

[56] References Cited

U.S. PATENT DOCUMENTS 3,525,908 8/1970 Allmendinger ..... 336/174 X

*Primary Examiner*—Thomas J. Kozma

*Attorney, Agent, or Firm*—Watson, Cole, Grindle & Watson

[57] ABSTRACT

A current transformer of the top core type for high voltage application is formed by a column of insulating material supporting a metal housing including an insulating body through which the primary conductor of the transformer passes. A plurality of cores each including a secondary winding of the transformer are enclosed in a grounded metal casing and extend around the central portion of the insulating body to form annular regions between the metal core casing and the metal housing. The dimensions and weight of the top part of the transformer are reduced by utilizing insulated metal rings provided for obtaining a uniform voltage distribution in the annular regions between the core casing and the housing. The insulated metal rings consist of metal foil between plates of insulating material and may completely fill the annular regions.

The core casing includes planar end pieces abutting the insulated metal rings. A barrier of solid insulating material may be wound around the metal core casing and the insulated metal rings. The insulated column may include a voltage-controlling capacitor bushing with a grounded tube forming the passageway for the secondary winding conductors. Second insulated metal rings may be arranged in a region around the upper part of the voltage-controlling capacitor bushing for voltage control between the metal core casing and the housing.

9 Claims, 1 Drawing Figure

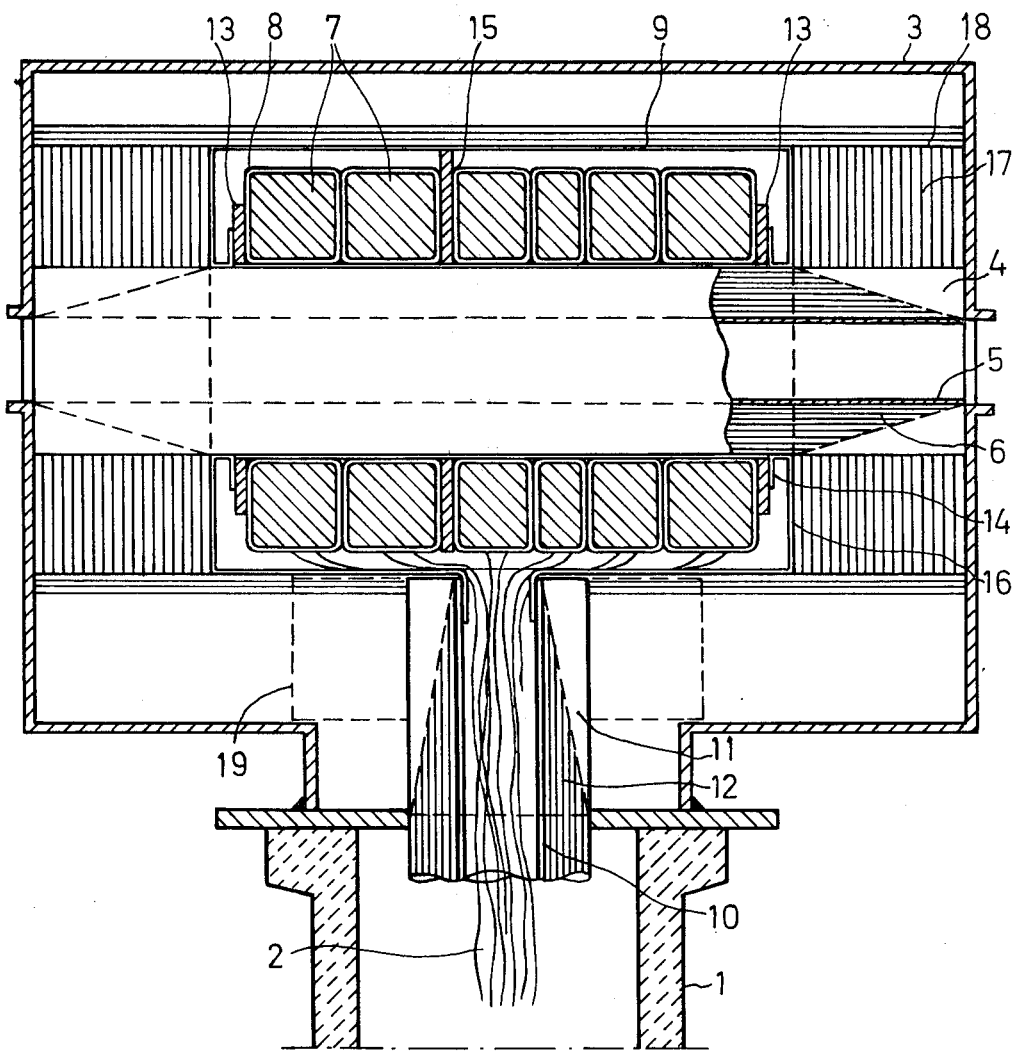
13
8
7
15
9
13
3
18
17
4
5
6
14
16
19
11
12
10
2
1

TOP CORE TYPE CURRENT TRANSFORMER STRUCTURE

BACKGROUND OF THE INVENTION

Field of the Invention

The present invention relates to current transformers of the so-called top core type. Such transformers consist of a support insulator, a metallic top housing carried by the support insulator and a bushing enclosed in the top housing, the bushing supporting the iron cores and the secondary windings. The primary winding generally consists of a straight conductor passing through the central opening of the bushing.

PRIOR ART

Top core current transformers are employed above all at relatively high voltages and provide considerable advantages, among other things because they can be constructed for considerably higher rated currents than current transformers of the so-called hairpin type, where the secondary windings and cores are arranged in the grounded bottom tank of the transformer.

The dimension of the top part of the transformer is to a great extent affected by the insulating distance between the cores at ground potential and the surrounding top housing at high potential. In order to keep this distance low, various attempts have been made to achieve as even a potential distribution as possible in the oil-filled space between the cores and the top housing.

In a current transformer of the above kind, known from Swiss patent No. 557,083, the iron cores and the secondary windings are surrounded by a grounded metal casing. This so-called core casing has the shape of a toroid, the cross-section of which is elongated with well rounded end portions. With such a shape it is possible to avoid local field concentrations in the surrounding oil-filled space. The risk of partial discharges close to the casing can be further reduced by providing the casing with a coating of solid insulating material. The specially rounded shape of the casing, however, increases the manufacture and mounting costs. Thus, for instance, the solid insulating coating cannot be applied by winding on a pre-fabricated tape or plate-formed insulating material, such as cardboard or the like, but the casing must be provided, for example electrostatically, with a coating of, for example, epoxy powder which is thereafter cured in a furnace. Such a coating is relatively expensive and may also be easily damaged during the subsequent handling of the casing.

SUMMARY OF THE INVENTION

In the construction of current transformers of the top core type, it is very important that the dimension and the weight of the top part of the transformer with its bushing, iron cores and windings can be held down, since this makes it possible to reduce the stresses to which the relatively high support insulator is exposed, for example in the case of strong winds or earthquakes. With smaller dimensions of the top part the oil quantity of the transformer is also reduced, the necessary capacity of the expansion system for the oil then being relatively moderate. In this way a hermetically closed oil system can be used, in which the volume changes of the oil with temperature variations are taken up by a simple diaphragm or the like.

The purpose of the present invention is to achieve a reduction of the dimensions of the top housing of a top core current transformer of the kind mentioned above, as well as to make it cheaper to manufacture. This is achieved by arranging insulated metal rings in the annular regions between the metal casing and the metal housing for capacitve control of the insulation distance between the casing and the housing.

In the following description the invention will be described with reference to an embodiment shown in the accompanying drawing showing only the top part of the transformer since the remaining part is constructed in a known manner, for example according to Swiss patent No. 557,083.

DETAILED DESCRIPTION

The current transformer comprises an elongated, tubular column 1 of insulating material, preferably porcelain, mounted on a preferably grounded box, which contains terminal members for the conductors from the secondary windings at the top of the transformer. At its top, column 1 supports top metal housing 3, which in turn supports an insulating body 4 in the form of a hollow cylinder constructed as a capacitor bushing and extending through metal housing 3. Insulating body or capacitor bushing 4 is built-up around tube 5 which is attached to housing 3 in a liquid-tight manner. Insulating body 4 is built-up in a known manner by winding insulating paper onto tube 5 and inserting metal layers 6 with an outwardly diminishing axial length between the paper turns. A number of annularly-shaped iron cores 7 are arranged around the central portion of the insulating body, each of the iron cores supporting a secondary winding 8. Iron cores 7 and windings 8 are enclosed in a metallic core casing 9 which, together with the outermost of the layers in capacitor bushing 4, is connected to ground through metal tube 10 passing centrally through column 1. Secondary winding conductors 2 are passed through tube 10.

Metal tube 10 in column 1 is surrounded by voltage-controlling insulating body 11 with capacitor layers 12. The outermost capacitor layer is connected to housing 3 which is at high voltage, whereas the innermost capacitor layer is at, or close to, ground potential and is suitably grounded by being connected to metal tube 10.

The two insulating bodies 4 and 11 are manufactured by winding paper with constant width on a central tube 5 and 10, respectively, together with conducting layers, for example metal foils. The width of the metal layers decreases from the inside outwardly, so that the area of the different layers is substantially constant throughout the entire body, thereby obtaining a uniform distribution of voltage.

Top housing 3 is filled with oil, and column 1 is filled only with oil or with oil with fillers, for example pure sand.

The primary conductor can either be passed through tube 5 in the top bushing or be connected at the ends of the tube, and in the latter case the tube itself acts as the primary conductor.

Top housing 3 is made in two parts to enable mounting of capacitor bushing 4 and the cores 7 arranged around the bushing. At the joint between the two housing parts, or at one of the connections of the housing to the bushing tube 5, an insulating spacer (not shown) may be arranged to prevent part of the primary current from flowing through the housing.

The cores 7 are mounted between two support rings 13 in core casing 9 and are secured by locking flaps 14 bent-up from the inner cylindrical part of core casing 9. One or more supporting rings 15 may also be arranged between the individual cores 7.

The areas between the plane end pieces 16 of core casing 9 and top housing 3 are filled with insulated metal rings 17, for example in the form of rings of metal foils arranged between annularly-shaped pieces of cardboard. These serve as control capacitors and provide a uniform voltage distribution along the insulation distance in question. In this way the lengths of the insulation distances and the dimensions of the top housings can be reduced. Also the manufacture of the core casing 9 becomes more simple since it can be made cylindrical with plane end pieces.

An insulating barrier 18 of, for example, cardboard is wound around core casing 9 and control capacitors 17. Further, in section 19 (shown by dashed lines) around the upper part 11 of the secondary bushing (not shown) there may be arranged a capacitive control formed of insulated metal rings similar to insulated metal rings 17 previously described.

What is claimed is:

1. Current transformer for high voltage application, comprising:

a column of insulating material supporting a metal housing including an insulating body through which the primary conductor of the transformer passes;

a plurality of cores each including a secondary winding of the transformer and being enclosed in a grounded metal core casing extends around the central portion of said insulating body to form annular regions between said metal core casing and said metal housing;

said annular regions lying in the axial extension of said metal casing; and insulated metal rings provided in said annular regions for achieving a uniform voltage distribution in said annular regions between said core casing and said housing.

2. Current transformer according to claim 1 wherein said annular regions lie in areas formed between said metal housing and said metal core casing and along the axial extension of the latter.

3. Current transformer according to claim 2, wherein said annular regions are completely filled by said insulated metal rings.

4. Current transformer according to claim 1, wherein said insulated metal rings consist of metal foil arranged between plates of insulating material.

5. Current transformer according to claim 1, wherein said core casing includes planar end pieces abutting said insulated metal rings.

6. Current transformer according to claim 1 further comprising a barrier of solid insulating material wound around said metal core casing and said insulated metal rings.

7. Current transformer according to claim 1 wherein said column includes a voltage-controlling capacitor bushing and further comprising a grounded tube forming a passageway for the secondary winding conductors in said housing and arranged within said voltage-controlling capacitor bushing; and second insulated metal rings are arranged in the region around the upper part of said voltage-controlling capacitor bushing for voltage control between said metal core casing and said housing.

8. Current transformer according to claim 6 wherein said voltage-controlling capacitor bushing is made from alternate layers of metal foil and paper with the inner layer connected to said metal tube and the outer layer connected to said housing.

9. Current transformer according to claim 8 wherein the width of the metal foil layers decreases from the inner layer outwardly whereby each metal layer has substantially the same area to provide a uniform distribution of voltage.

* * * * *